US005128109A

United States Patent [19]

Owen

[11] Patent Number: 5,128,109

[45] Date of Patent: * Jul. 7, 1992

[54] HEAVY OIL CATALYTIC CRACKING APPARATUS

[75] Inventor: Hartley Owen, Belle Mead, N.J.

[73] Assignee: Mobil Oil Corporation, Fairfax, Va.

[ * ] Notice: The portion of the term of this patent subsequent to Apr. 11, 2006 has been disclaimed.

[21] Appl. No.: 464,069

[22] Filed: Jan. 12, 1990

Related U.S. Application Data

[62] Division of Ser. No. 335,643, Apr. 10, 1989, Pat. No. 4,917,790.

[51] Int. Cl.[5] ..... F27B 15/12; F27B 15/16; B01J 8/26

[52] U.S. Cl. ..... 422/144; 208/113; 208/48 R; 208/48 Q; 422/145; 422/146; 422/147

[58] Field of Search ..... 422/144-147; 208/153, 113, 48 R, 48 Q

[56] References Cited

U.S. PATENT DOCUMENTS

| | | | |
|---|---|---|---|
| 2,584,391 | 2/1952 | Leffer | 422/146 X |
| 4,353,812 | 10/1982 | Lomas et al. | 252/417 |
| 4,587,010 | 5/1986 | Blaser et al. | 422/144 X |
| 4,820,404 | 4/1989 | Owen | 208/159 |
| 4,946,656 | 8/1990 | Ross et al. | 422/144 |
| 4,961,907 | 10/1990 | Herbst et al. | 422/144 |
| 4,990,314 | 2/1991 | Herbst et al. | 422/144 |
| 5,000,841 | 3/1991 | Owen | 422/144 X |

*Primary Examiner*—Robert J. Warden
*Assistant Examiner*—Amalia L. Santiago
*Attorney, Agent, or Firm*—Alexander J. McKillop; Charles J. Speciale; Richard D. Stone

[57] ABSTRACT

A fluidized catalytic cracking process and apparatus operates with a two stage hot stripper between the reactor and catalyst regenerator. Addition of hot, regenerated catalyst to spent catalyst from the reactor heats the spent catalyst in the first stripping stage, which preferably uses steam stripping gas. The second stage of stripping occurs about a heat removal stab-in heat exchanger tube bundle, which removes heat from the catalyst during the second stage of stripping. Steam or flue gas may be used in the second stripping stage to fluidize catalyst, improve heat transfer and simultaneously strip the catalyst.

5 Claims, 1 Drawing Sheet

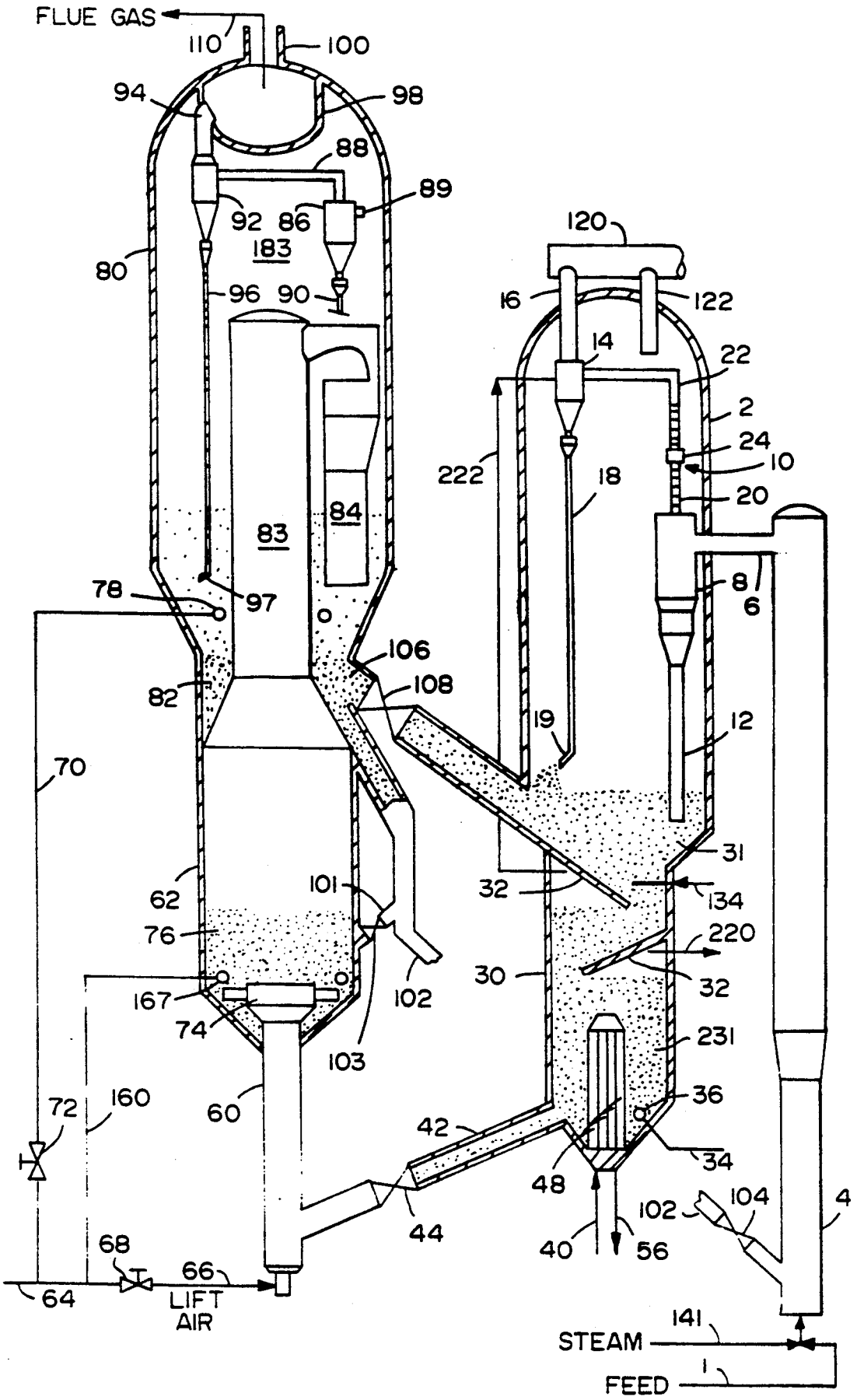
FLUE GAS
110
100
94
98
88
89
92
86
183
80
96
90
120
16
122
14
22
2
24
10
222
18
20
84
83
8
6
78
97
106
108
82
19
12
70
31
62
101
32
134
76
220
30
32
167
102
74
231
103
36
72
160
60
42
34
48
4
102
104
44
40
56
68
66
64
LIFT
AIR
141
STEAM
1
FEED

HEAVY OIL CATALYTIC CRACKING APPARATUS

This is a divisional of copending application Ser. No. 335,643, filed on Apr. 10, 1989 now U.S. Pat. No. 4,917,790 issued Apr. 17, 1990.

BACKGROUND OF THE INVENTION

1. Field of the Invention

The field of the invention is regeneration of coked cracking catalyst in a fluidized bed.

2. Description of Related Art

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the fluid catalytic cracking (FCC) process has been to all riser cracking and use of zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite-containing catalysts having high activity and selectivity are now used in most FCC units. These catalysts work best when coke on the catalyst after regeneration is less than 0.1 wt %, and preferably less than 0.05 wt %.

To regenerate FCC catalysts to these low residual carbon levels, and to burn CO completely to CO2 within the regenerator (to conserve heat and minimize air pollution) many FCC operators add a CO combustion promoter metal to the catalyst or to the regenerator.

U.S. Pat. Nos. 4,072,600 and 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade a wider range of feedstocks, in particular, feedstocks that were heavier, and also contained more metals and sulfur than had previously been permitted in the feed to a fluid catalytic cracking unit.

These heavier, dirtier feeds have placed a growing demand on the regenerator. Processing resids has exacerbated four existing problem areas in the regenerator, sulfur, steam, temperature and NOx. These problems will each be reviewed in more detail below.

Sulfur

Much of the sulfur in the feed ends up as SOx in the regenerator flue gas. Higher sulfur levels in the feed, combined with a more complete regeneration of the catalyst in the regenerator increases the amount of SOx in the regenerator flue gas. Some attempts have been made to minimize the amount of SOx discharged to the atmosphere through the flue gas by including catalyst additives or agents to react with the SOx in the flue gas. These agents pass with the regenerated catalyst back to the FCC reactor where the reducing atmosphere releases the sulfur compounds as H2S. Suitable agents are described in U.S. Pat. Nos. 4,071,436 and 3,834,031. Use of cerium oxide agent for this purpose is shown in U.S. Pat. No. 4,001,375.

Unfortunately, the conditions in most FCC regenerators are not the best for SOx adsorption. The high temperatures in modern FCC regenerators (up to 870 C. (1600 F.)) impair SOx adsorption. One way to minimize SOx in flue gas is to pass catalyst from the FCC reactor to a long residence time steam stripper, as disclosed in U.S. Pat. No. 4,481,103 to Krambeck et al which is incorporated by reference. This process preferably steam strips spent catalyst at 500–550 C. (932 to 1022 F.), which is beneficial but not sufficient to remove some undesirable sulfur- or hydrogen-containing components.

Steam

Steam is always present in FCC regenerators although it is known to cause catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from an FCC stripper to an FCC regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration. However, the flue gas from both stages of regeneration contains SOx which is difficult to clean. It would be beneficial, even in staged regeneration, if the amount of water precursors present on stripped catalyst was reduced.

Steaming of catalyst becomes more of a problem as regenerators get hotter. Higher temperatures greatly accelerate the deactivating effects of steam.

Temperature

Regenerators are operating at higher and higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator gets hotter, and the extra heat is rejected as high temperature flue gas. Many refiners severely limit the amount of resid or similar high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by Occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio produced in the regenerator. Burning coke partially to CO produces less heat than complete combustion to CO2. However, in some cases, this control is insufficient, and also leads to increased CO emissions, which can be a problem unless a CO boiler is present.

U.S. Pat. No. 4,353,812 to Lomas et al, which is incorporated by reference, discloses cooling catalyst from a regenerator by passing it through the shell side of a heat-exchanger with a cooling medium through the tube side. The cooled catalyst is recycled to the regeneration zone. This approach will remove heat from the regenerator, but will not prevent poorly, or even well, stripped catalyst from experiencing very high surface or localized temperatures in the regenerator. The Lomas process does not control the temperature of catalyst from the reactor stripper to the regenerator.

The prior art also used dense or dilute phase regenerated fluid catalyst heat removal zones or heat-exchangers that are remote from, and external to, the regenerator vessel to cool hot regenerated catalyst for return to the regenerator. Examples of such processes are found in U.S. Pat. Nos. 2,970,117 to Harper; 2,873,175 to Owens; 2,862,798 to McKinney; 2,596,748 to Watson et al; 2,515,156 to Jahnig et al; 2,492,948 to Berger; and 2,506,123 to Watson. In these processes the regenerator operating temperature is affected by the temperature of catalyst from the stripper.

Nox

Burning of nitrogenous compounds in FCC regenerators has long led to creation of minor amounts of NOx, some of which were emitted with the regenerator flue gas. Usually these emissions were not much of a problem because of relatively low temperature, a relatively reducing atmosphere from partial combustion of CO and the absence of catalytic metals like Pt in the regenerator which increase NOx production.

Many FCC units now operate at higher temperatures, with a more oxidizing atmosphere, and use CO combustion promoters such as Pt. These changes in regenerator operation reduce CO emissions, but usually increase nitrogen oxides (NOx) in the regenerator flue gas. It is difficult in a catalyst regenerator to completely burn coke and CO in the regenerator without increasing the NOx content of the regenerator flue gas, so NOx emissions are now frequently a problem.

Recent catalyst patents include U.S. Pat. No. 4,300,997 and its division U.S. Pat. No. 4,350,615, both directed to the use of Pd-Ru CO-combustion promoter. The bi-metallic CO combustion promoter is reported to do an adequate job of converting CO to CO2, while minimizing the formation of NOx.

U.S. Pat. No. 4,199,435 suggests steam treating conventional metallic CO combustion promoter to decrease NOx formation without impairing too much the CO combustion activity of the promoter.

Process modifications are suggested in U.S. Pat. No. 4,413,573 and U.S. Pat. No. 4,325,833 directed to two- and three-stage FCC regenerators, which reduce NOx emissions.

U.S. Pat. No. 4,313,848 teaches countercurrent regeneration of spent FCC catalyst, without backmixing, to minimize NOx emissions.

U.S. Pat. No. 4,309,309 teaches the addition of a vaporizable fuel to the upper portion of a FCC regenerator to minimize NOx emissions. Oxides of nitrogen formed in the lower portion of the regenerator are reduced in the reducing atmosphere generated by burning fuel in the upper portion of the regenerator.

U.S. Pat. No. 4,235,704 suggests that too much CO combustion promoter causes NOx formation, and calls for monitoring the NOx content of the flue gases, and adjusting the concentration of CO combustion promoter in the regenerator based on the amount of NOx in the flue gas.

The approach taken in U.S. Pat. No. 4,542,114 is to minimize the volume of flue gas by using oxygen rather than air in the FCC regenerator, with consequent reduction in the amount of flue gas produced.

All the catalyst and process patents discussed above, directed to reducing NOx emissions, from U.S. Pat. No. 4,300,997 to U.S. Pat. No. 4,542,114, are incorporated herein by reference.

The reduction in NOx emissions achieved by the above approaches helps some but still may fail to meet the ever more stringent NOx emissions limits set by local governing bodies. Much of the NOx formed is not the result of combustion of N2 within the FCC regenerator, but rather combustion of nitrogen-containing compounds in the coke entering the FCC regenerator. Bimetallic combustion promoters are probably best at minimizing NOx formation from N2.

Unfortunately, the trend to heavier feeds usually means that the amount of nitrogen compounds on the coke will increase and that NOx emissions will increase. Higher regenerator temperatures also tend to increase NOx emissions. It would be beneficial, in many refineries, to have a way to burn at least a large portion of the nitrogenous coke in a relatively reducing atmosphere, so that much of the NOx formed could be converted into N2 within the regenerator. Unfortunately, most existing regenerator designs can not operate efficiently at such conditions, i.e., with a reducing atmosphere.

It would be beneficial if a better stripping process were available which would permit increased recovery of valuable, strippable hydrocarbons. There is a need for a higher temperature stripper, which will not lead to a higher temperature regenerator. There is a special need to remove more hydrogen from spent catalyst to minimize hydrothermal degradation in the regenerator. It would be further advantageous to remove more sulfur-containing compounds from spent catalyst prior to regeneration to minimize SOx in the regenerator flue gas. Also, it would be advantageous to have a better way to control regenerator temperature.

I have found a way to achieve much better high temperature stripping of coked FCC catalyst. My solution not only improves stripping, and increases the yield of valuable liquid product, it reduces the load placed on the catalyst regenerator, minimizes SOx emissions, and permits the unit to process more difficult feeds. Regenerator temperatures can be reduced, or maintained constant while processing worse feeds, and the amount of hydrothermal deactivation of catalyst in the regenerator can be reduced.

BRIEF SUMMARY OF THE INVENTION

Accordingly, the present invention provides a fluidized catalytic cracking process wherein a heavy hydrocarbon feed comprising hydrocarbons having a boiling point above about 650 F. is catalytically cracked to lighter products comprising the steps of catalytically cracking said feed in a catalytic cracking zone operating at catalytic cracking conditions by contacting said feed with a source of hot regenerated catalyst to produce a cracking zone effluent mixture having an effluent temperature and comprising cracked products and spent cracking catalyst containing coke and strippable hydrocarbons; separating said cracking zone effluent mixture into a cracked product rich vapor phase and a solids rich phase comprising said spent catalyst and strippable hydrocarbons, said solids rich phase having a temperature; heating said solids rich phase by mixing it with a source of hot regenerated catalyst having a higher temperature than said solids rich phase to produce a catalyst mixture comprising spent and regenerated catalyst having a catalyst mixture temperature intermediate said solids rich phase temperature and the temperature of the regenerated catalyst; stripping in a primary stripping stage said catalyst mixture with a stripping gas to remove strippable compounds from spent catalyst; passing said catalyst mixture from said primary stripping stage to a secondary stripping stage; stripping and cooling said catalyst mixture in said secondary stripping stage by fluidizing said catalyst mixture with a stripping gas and removing heat from said catalyst mixture by indirect heat exchange with a heat exchange means having a heat transfer coefficient and wherein the heat transfer coefficient for indirect heat exchange from said catalyst mixture across said heat exchange means is higher than a heat transfer coefficient across said indirect heat exchange means obtainable without the presence of added stripping gas in said secondary stripping stage, to produce a cooled, stripped catalyst mixture with a reduced content of strippable hydrocarbons; regenerating said cooled, stripped catalyst mixture by contact with oxygen or an oxygen containing gas in a regenerating means to produce regenerated catalyst having a higher temperature than said catalyst mixture temperature as a result of combustion of coke on said spent catalyst; recycling to the cracking reaction zone a portion of the regenerated catalyst to crack more hydrocarbon feed; and recycling to the primary stripping stage a portion of the regenerated catalyst to heat spent catalyst.

In another embodiment, the present invention provides an apparatus for the fluidized catalytic cracking of a heavy hydrocarbon feed comprising hydrocarbons having a boiling point above about 650 F. to lighter products by contacting said feed with catalytic cracking catalyst, said apparatus comprising a catalytic cracking reactor means having an inlet connective with said feed and with a source of hot regenerated catalyst and having an outlet for discharging a cracking zone effluent mixture comprising cracked products and spent cracking catalyst containing coke and strippable hydrocarbons; a separation means connective with said reactor outlet for separating said cracking zone effluent mixture into a cracked product rich vapor phase and a solids rich phase comprising said spent catalyst and strippable hydrocarbons; a primary stripping means comprising an inlet for a source of hot regenerated cracking catalyst, an inlet for spent catalyst, an inlet for a stripping gas, a vapor outlet for a primary stripping stage vapor and a solids outlet for discharge of stripped solids; a secondary stripping means comprising a vessel adapted to contain a fluidized bed of catalyst and having an inlet for stripped solids connective with the solids outlet of said primary stripping means, an indirect heat exchange means immersed at an elevation within the fluidized bed of catalyst in the secondary stripping vessel for removal of heat, an inlet for a secondary stage stripping gas at an elevation below said heat exchange means, an outlet for stripped catalyst; a catalyst regeneration means having an inlet connective with said catalyst outlet from said secondary stripping means, a regeneration gas inlet, a flue gas outlet, and an outlet for removal of hot regenerated catalyst; and catalyst recycle means connective with said catalytic cracking reaction zone and with said primary stripping zone.

BRIEF DESCRIPTION OF THE DRAWING

The FIGURE is a simplified schematic view of an FCC unit with a hot stripper of the invention.

DETAILED DESCRIPTION

The present invention can be better understood by reviewing it in conjunction with the FIGURE, which illustrates a fluid catalytic cracking system of the present invention. Although a preferred FCC unit is shown, any riser reactor and regenerator can be used in the present invention.

A heavy feed is charged via line 1 to the lower end of a riser cracking FCC reactor 4. Hot regenerated catalyst is added via standpipe 102 and control valve 104 to mix with the feed. Preferably, some atomizing steam is added via line 141 to the base of the riser, usually with the feed. With heavier feeds, e.g., a resid, 2–10 wt. % steam may be used. A hydrocarbon-catalyst mixture rises as a generally dilute phase through riser 4. Cracked products and coked catalyst are discharged via riser effluent conduit 6 into first stage cyclone 8 in vessel 2. The riser top temperature, the temperature in conduit 6, ranges between about 480 and 615 C. (900 and 1150 F.), and preferably between about 538 and 595 C. (1000 and 1050 F.). The riser top temperature is usually controlled by adjusting the catalyst to oil ratio in riser 4 or by varying feed preheat.

Cyclone 8 separates most of the catalyst from the cracked products and discharges this catalyst down via dipleg 12 to a stripping zone 30 located in a lower portion of vessel 2. Vapor and minor amounts of catalyst exit cyclone 8 via gas effluent conduit 20 and flow into connector 24, which allows for thermal expansion, to conduit 22 which leads to a second stage reactor cyclone 14. The second cyclone 14 recovers some additional catalyst which is discharged via dipleg 18 to the stripping zone 30.

The second stage cyclone overhead stream, cracked products and catalyst fines, passes via effluent conduit 16 and line 120 to product fractionators not shown in the figure. Stripping vapors enter the atmosphere of the vessel 2 and exit this vessel via outlet line 22 or by passing through the annular space 10 defined by outlet 20 and inlet 24.

The coked catalyst discharged from the cyclone diplegs collects as a bed of catalyst 31 in the stripping zone 30. Dipleg 12 is sealed by being extended into the catalyst bed 31. Dipleg 18 is sealed by a trickle valve 19.

Although only two cyclones 8 and 14 are shown, many cyclones, 4 to 8, are usually used in each cyclone separation stage. A preferred closed cyclone system is described in U.S. Pat. No. 4,502,947 to Haddad et al, which is incorporated by reference.

Stripper 30 has a first stage and a second stage of stripping. The first stage of stripping occurs in dense phase fluidized bed 31. The first stage of stripping is "hot". Spent catalyst is mixed in bed 31 with hot catalyst from the regenerator. Direct contact heat exchange heats spent catalyst. The regenerated catalyst, which has a temperature from 55 C. (100 F.) above the stripping zone 30 to 871 C. (1600 F.), heats spent catalyst in bed 31. Catalyst from regenerator 80 enters vessel 2 via transfer line 106, and slide valve 108 which controls catalyst flow. Adding hot, regenerated catalyst permits first stage stripping at from 55 C. (100 F.) above the riser reactor outlet temperature and 816 C. (1500 F.). Preferably, the first stage stripping zone operates at least 83 C. (150 F. ) above the riser top temperature, but below 760 C. (1400 F.).

In bed 31 a stripping gas, preferably steam, flows countercurrent to the catalyst. The stripping gas is preferably introduced into the lower portion of bed 31 by one or more conduits 134. The first catalyst stripping zone bed 31 preferably contains trays (baffles) 32. The trays may be disc- and doughnut-shaped and may be perforated or unperforated.

The catalyst residence time in bed 31 in the stripping zone 30 preferably ranges from 1 to 7 minutes. The vapor residence time in the bed 31, the first stage stripping zone, preferably ranges from 0.5 to 30 seconds, and most preferably 0.5 to 5 seconds.

High temperature stripping removes coke, sulfur and hydrogen from the spent catalyst. Coke is removed because carbon in the unstripped hydrocarbons is burned as coke in the regenerator. The sulfur is removed as hydrogen sulfide and mercaptans. The hydrogen is removed as molecular hydrogen, hydrocarbons, and hydrogen sulfide. The removed materials also increase the recovery of valuable liquid products, because the stripper vapors can be sent to product recovery with the bulk of the cracked products from the riser reactor. High temperature stripping can reduce coke load to the regenerator by 30 to 50% or more and remove 50–80% of the hydrogen as molecular hydrogen, light hydrocarbons and other hydrogen-containing compounds, and remove 35 to 55% of the sulfur as hydrogen sulfide and mercaptans, as well as a portion of nitrogen as ammonia and cyanides.

After high temperature stripping in bed 31, the catalyst has a much reduced content of strippable hydrocarbons, but still contains some strippable hydrocarbons. The catalyst from bed 31 is also too hot to be charged to the regenerator. The combination of high initial temperature, and rapid combustion of residual strippable hydrocarbons, and to a lesser extent of coke, could result in extremely high localized temperatures on the surface of the catalyst during regeneration. To minimize, to the maximum extent possible, the amount of strippable hydrocarbons present, and to reduce the bulk temperature of the hot stripped catalyst, the present invention provides for a second stage of catalyst stripping which also cools the catalyst.

The hot stripped catalyst from bed 31 passes down through baffles 32 and is discharged into dense phase fluidized bed 231. A stab in heat exchanger or tube bundle 48 is inserted into the lower portion of bed 231. For effective heat exchange, the bed 231 should be fluidized with a gas or vapor, added via line 34 and distributing means 36. Reducing the temperature of the catalyst in bed 231 will not improve stripping efficiency over that achieved at a higher temperature in bed 31. The additional stage of stripping will remove an additional increment of hydrogen, sulfur, etc. from the catalyst, by virtue of more contact time, contact with fresh stripping gas, and better contacting of spent catalyst with stripping gas (flow of catalyst through bed 31 frequently will not be uniform, and some of the catalyst may not be well stripped despite the overall severe stripping conditions in bed 31).

The present invention, in providing a second stage of stripping, while simultaneously removing heat from catalyst in bed 231, makes double use of the stripping medium added via line 34. Stripping gas not only strips, it improves the heat transfer coefficient achieved across tube bundle 48, permitting maximum transfer of heat from hot catalyst to fluid in line 40 (typically boiler feed water or low grade stream) to produce heated heat transfer fluid in line 56 (typically high grade steam.)

Although stream may be used as the stripping medium in line 36, other stripping fluids such as flue gas may also be used. Depending on the stripping fluid added via line 36, it may be beneficial to remove the stripped material via line 220 so that the inerts, etc., will not be mixed with cracked hydrocarbon products. Stripper vapors from the second stage of stripping may also be discharged via line 222 to the second stage cyclone 14, so that stripped hydrocarbons may be recovered as product and entrained catalyst recycled to the stripping zone.

Although not shown in the Figure, cyclones, porous stainless steel filter, and similar devices may be used to separate catalyst and fines from vapor streams withdrawn via lines 222 and 220.

The temperature profile in the second stage stripper will be favorable for moderately effective stripping in the upper portions thereof, and for maximum temperature reduction in the lower portion. The temperature of catalyst entering the second stage of stripping will be about equal to that of catalyst exiting the first stripping zone, or bed 31. There will be minimal reduction in temperature in bed 231 due to the temperature of the stripping gas; there is so much more catalyst than stripping gas that only modest reductions in temperature will occur when cold stripping gas is used. The bulk of the temperature drop occurs across and around the stab in heat exchanger bundle 48.

Preferably the catalyst exiting the second stage stripper is at least 50° F. cooler than the catalyst in the hot stripper, or bed 31. More preferably, the catalyst leaving the stripper via line 42 is 75-200 F. cooler than the catalyst in bed 31.

Although not shown in the Figure, an external catalyst stripper/cooler, with inlets for hot catalyst and fluidization gas, and outlets for cooled catalyst and stripper vapor, may also be used. In some units, there may be mechanical constraints preventing use of a stab in tube bundle as shown in the drawing. The essential features, use of fluidizing gas both to improve heat transfer across the heat exchange means and to obtain a second stage of stripping, remain the same when an external stripper/cooler is used.

An external unit functioning like a thermosiphon reboiler may be used to permit triple use of stripping gas, for stripping, heat exchange, and to move spent catalyst from a low elevation to a higher elevation. In such a unit, both hot catalyst and stripping gas would enter the bottom of the unit, would flow co-currently up across or alongside of a heat exchange bundle, and discharge together into the stripper or into the catalyst regenerator catalyst inlet.

Stripped catalyst passes through a stripped cooled catalyst effluent line 42. A catalyst cooler, not shown, may be provided to further cool the catalyst, if necessary to maintain the regenerator 80 at a temperature between 55 C. (100 F.) above the temperature of the stripping zone 30 and 871 C. (1600 F.). An external catalyst cooler, cooling the stripped catalyst before it enters the regenerator vessel, will not remove any strippable hydrocarbons.

When an external catalyst cooler is used it preferably is an indirect heat-exchanger using a heat-exchange medium such as liquid water (boiler feed water).

The cooled catalyst passes through the conduit 42 into regenerator riser 60. Air and cooled catalyst combine and pass up through an air catalyst disperser 74 into coke combustor 62 in regenerator 80. In bed 62, combustible materials, such as coke on the cooled catalyst, are burned by contact with air or oxygen containing gas. At least a portion of the air passes via line 66 and line 68 to riser-mixer 60.

Preferably the amount of air or oxygen containing gas added via line 66, to the base of the riser mixer 60, is restricted to 50-95% of total air addition to the regenerator 80. Restricting the air addition slows down to some extent the rate of carbon burning in the riser mixer, and in the process of the present invention it is the intent to minimize as much as possible the localized high temperature experienced by the catalyst in the regenerator. Limiting the air limits the burning and temperature rise experienced in the riser mixer, and limits the amount of catalyst deactivation that occurs there. It also ensures that most of the water of combustion, and resulting steam, will be formed at the lowest possible temperature.

Additional air, preferably 5-50% of total air, is preferably added to the coke combustor via line 160 and air ring 167. In this way the regenerator 80 can be supplied with as much air as desired, and can achieve complete afterburning of CO to CO2, even while burning much of the hydrocarbons at relatively mild, even reducing conditions, in riser mixer 60.

To achieve the high temperatures usually needed for rapid coke combustion, and to promote CO afterburning, the temperature of fast fluidized bed 76 in the coke combustor 62 may be, and preferably is, increased by recycling some hot regenerated catalyst thereto via line 101 and control valve 103.

In coke combustor 62 the combustion air, regardless of whether added via line 66 or 166, fluidizes the catalyst in bed 76, and subsequently transports the catalyst continuously as a dilute phase through the regenerator riser 83. The dilute phase passes upwardly through the riser 83, through a radial arm 84 attached to the riser 83. Catalyst passes down to form a second relatively dense bed of catalyst 82 located within the regenerator 80.

While most of the catalyst passes down through the radial arms 84, the gases and some catalyst pass into the atmosphere or dilute phase region 183 of the regenerator vessel 80. The gas passes through inlet conduit 89 into the first regenerator cyclone 86. Some catalyst is recovered via a first dipleg 90, while remaining catalyst and gas passes via overhead conduit 88 into a second regenerator cyclone 92. The second cyclone 92 recovers more catalyst, and passes it via a second dipleg 96 having a trickle valve 97 to the second dense bed. Flue gas exits via conduit 94 into plenum chamber 98. A flue gas stream 110 exits the plenum via conduit 100.

The hot, regenerated catalyst forms the bed 82, which is substantially hotter than the stripping zone 30. Bed 82 is at least 55 C. (100 F.) hotter than stripping zone 31, and preferably at least 83 C. (150 F.) hotter. The regenerator temperature is, at most, 871 C. (1600 F.) to prevent deactivating the catalyst.

Optionally, air may also be added via line 70, and control valve 72, to an air header 78 located in dense bed 82.

Adding combustion air to second dense bed 82 allows some of the coke combustion to be shifted to the relatively dry atmosphere of dense bed 82, and minimize hydrothermal degradation of catalyst. There is an additional benefit, in that the staged addition of air limits the temperature rise experienced by the catalyst at each stage, and limits somewhat the amount of time that the catalyst is at high temperature.

Preferably, the amount of air added at each stage (riser mixer 60, coke combustor 62, transport riser 83, and second dense bed 82) is monitored and controlled to have as much hydrogen combustion as soon as possible and at the lowest possible temperature while carbon combustion occurs as late as possible, and highest temperatures are reserved for the last stage of the process. In this way, most of the water of combustion, and most of the extremely high transient temperatures due to burning of poorly stripped hydrocarbon occur in riser mixer 60 where the catalyst is coolest. The steam formed will cause hydrothermal degradation of the zeolite, but the temperature will be so low that activity loss will be minimized. Reserving some of the coke burning for the second dense bed will limit the highest temperatures to the driest part of the regenerator. The water of combustion formed in the riser mixer, or in the coke combustor, will not contact catalyst in the second dense bed 82, because of the catalyst flue gas separation which occurs exiting the dilute phase transport riser 83.

There are several constraints on the process. If complete CO combustion is to be achieved, temperatures in the dilute phase transport riser must be high enough, or the concentration of CO combustion promoter must be great enough, to have essentially complete combustion of CO in the transport riser. Limiting combustion air to the coke combustor or to the dilute phase transport riser (to shift some coke combustion to the second dense bed 82) will make it more difficult to get complete CO combustion in the transport riser. Higher levels of CO combustion promoter will promote the dilute phase burning of CO in the transport riser while having much less effect on carbon burning rates in the coke combustor or transport riser.

If the unit operates in only partial combustion mode, to allow only partial CO combustion, and shift heat generation, to a CO boiler downstream of the regenerator, then much greater latitude re air addition at different points in the regenerator is possible. Partial CO combustion will also greatly reduce emissions of NOx associated with the regenerator. Partial CO combustion is a good way to accommodate unusually bad feeds, with CCR levels exceeding 5 or 10 wt %. Downstream combustion, in a CO boiler, also allows the coke burning capacity of the regenerator to increase and permits much more coke to be burned using an existing air blower of limited capacity Regardless of the relative amounts of combustion that occur in the various zones of the regenerator, and regardless of whether complete or only partial CO combustion is achieved, the catalyst in the second dense bed 82 will be the hottest catalyst, and will be preferred for use as a source of hot, regenerated catalyst for heating spent, coked catalyst in the catalyst stripper of the invention. Preferably, hot regenerated catalyst is withdrawn from dense bed 82 and passed via line 106 and control valve 108 into dense bed of catalyst 31 in stripper 30.

Now that the invention has been reviewed in connection with the embodiment shown in the Figure, a more detailed discussion of the different parts or the process and apparatus of the present invention follows. Many elements of the present invention can be conventional, such as the cracking catalyst, so only a limited discussion of such elements is necessary.

FCC FEED

Any conventional FCC feed can be used. The process of the present invention is especially useful for processing difficult charge stocks, those with high levels of CCR material, exceeding 2, 3, 5 and even 10 wt % CCR. The process, especially when operating in a partial CO combustion mode, tolerates feeds which are relatively high in nitrogen content, and which otherwise might result in unacceptable NOx emissions in conventional FCC units.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful when feeds contain more than 5, or more than 10 wt % material which is not normally distillable in refineries. Usually all of the feed will boil above 650 F., and 5 wt %, 10 wt % or more will boil above 1000 F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds.

The FCC reactor conditions, per se, are conventional and form no part of the present invention.

CATALYST STRIPPER/COOLER

The catalyst stripper cooler is the essence of the present invention. Its functions are to heat spent catalyst, rigorously strip it, then cool it before regeneration.

Heating of the coked, or spent catalyst is the first step. Direct contact heat exchange of spent catalyst with a source of hot regenerated catalyst is used to efficiently heat spent catalyst.

Spent catalyst from the reactor, usually at 900 to 1150 F., preferably at 950 to 1100 F., is charged to the stripping zone of the present invention and contacts hot regenerated catalyst at a temperature of 1200–1700 F., preferably at 1300–1600 F. The spent and regenerated catalyst can simply be added to a conventional stripping zone with no special mixing steps taken. The slight fluidizing action of the stripping gas, and the normal amount of stirring of catalyst passing through a conventional stripper will provide enough mixing effect to heat the spent catalyst. Some mixing of spent and regenerated catalyst is preferred, both to promote rapid heating of the spent catalyst and to ensure even distribution of spent catalyst through the stripping zone. Mixing of spent and regenerated catalyst may be promoted by providing some additional fluidizing steam or other stripping gas at or just below the point where the two catalyst streams mix. Splitters, baffles or mechanical agitators may also be used if desired.

The amount of hot regenerated catalyst added to spent catalyst can vary greatly depending on the stripping temperature desired and on the amount of heat to be removed via the stripper heat removal means discussed in more detail below. In general, the weight ratio of regenerated to spent catalyst will be from 1:10 to 10:1, preferably 1:5 to 5:1 and most preferably 1:2 to 2:1. High ratios of regenerated to spent catalyst will be used when extremely high stripping efficiency is needed or when large amounts of heat removal are sought in the stripper catalyst cooler. Small ratios will be used when the desired stripping temperature; or stripping efficiency can be achieved with smaller amounts of regenerated catalyst, or when heat removal from the stripper cooler must be limited.

High temperature stripping conditions will usually include temperature at least 50 F. higher than the reactor riser outlet but should be less than about 1500 F. Preferably, temperatures range from 75 F. above the reactor outlet and about 1300 F. Best results will usually be achieved with hot stripping temperatures of 1050–1200 F.

After the first stage of stripping in bed 31, the mixture of regenerated and spent catalyst is given a second stage of stripping, and simultaneously cooled by indirect heat exchange. The second stage of stripping is preferably conducted immediately after the first, or high temperature stripping stage. The second stage may be in the base of a vessel 30 containing both stripping stages, as shown in the Figure, or the second stage may be in a separate vessel.

The second stage of stripping is characterized by a reduced temperature, not necessarily at the inlet but certainly at the outlet. The second stage may use the same stripping gas as the first stage (usually steam will be used in the first or high temperature stripping stage). The stripper vapors from the second stage may be mixed with cracked product vapor, with stripper vapor generated in the first stage, or treated separately from any other vapor stream around the FCC unit. The process of the present invention is amenable to use of flue gas or CO or other specialized stripping gas designed to bring about some chemical reaction in addition to stripping.

In many instances, more steam will be the preferred stripping medium in the second stage, with second stage stripper vapors simply being mixed with the first stage stripper vapor. Preferably a separate stripper vapor outlet is provided for the second stage, so that the stripper/cooler vapor can be removed rather than forced to pass through the first stage stripper.

Cooling of the stripped catalyst in the second stage stripper is essential. A dimpled jacked heat exchanger, stab in tube bundle, circular tubes, etc. can be used to provide a means to remove heat from the catalyst in the second stage stripper. A stab in tube bundle, as shown in the drawing, is preferred because such items are readily available from equipment vendors and are easy to install in existing or new FCC strippers. The tube bundle can freely expand and contract with changes in temperature, so the device need only be sealed at the base thereof, where it is stabbed into the stripper.

As an alternate, or adjunct, to a stab in heat exchanger a separate, second stage stripping vessel may be provided. Hot catalyst from the first stage stripper can be discharged into a second stage stripper vessel containing a heat exchanger means, an inlet for fluidizing/-stripping gas, an outlet for cooled, well stripped catalyst, and an outlet for second stage stripping vapor.

When there is not enough room in an existing FCC to stab in a long heat exchange bundle to the base of an existing stripper, or where a second stage stripper could be added, but gravity flow from the second stage stripper to the catalyst regenerator would not be possible, use of a separate, second stage stripper vessel will be preferred. So long as the second stage stripper receives hot catalyst from the first stage stripper, and strips it and cools it simultaneously, the end result will be the same. A separate vessel, functioning as a thermosiphon reboiler is a preferred embodiment of the second stage stripper. In this embodiment the second stage stripper behaves like a reboiler in a distillation column. A fluid is added to a pot, "boiled" with stripping vapor, and the boiling fluid recycles back to the base of the first stage stripper, where cooled, stripped catalyst can separate from stripper vapor. In this embodiment, extremely large mass flows of hot catalyst across a heat exchange surface can be achieved at the price of greater consumption of energy, in blowing the stripping fluid into the base of the thermosiphon to carry tons and tons of catalyst to a higher elevation for discharge into the base of the primary stripper, or into the FCC regenerator.

Addition of a stripping gas is essential for good stripping and to provide fluidization and agitation needed for efficient heat transfer. Dense phase, fluidized bed heat transfer coefficients are high and readily calculable.

CATALYST REGENERATION

The invention can benefit FCC units using any type of regenerator, ranging from single dense bed regenerators to the more modern, high efficiency design shown in the Figure.

Single, dense phase fluidized bed regenerators can be used, but are not preferred. These generally operate with spent catalyst and combustion air added to a dense phase fluidized bed in a large vessel. There is a relatively sharp demarcation between the dense phase and a dilute phase above it. Hot regenerated catalyst is withdrawn from the dense bed for reuse in the catalytic cracking process, and for use in the hot stripper of the present invention.

High efficiency regenerators, preferably as shown and described in the Figure, are the preferred catalyst regenerators for use in the practice of the present invention.

FCC REGENERATOR CONDITIONS

The temperatures, pressures, oxygen flow rates, etc., are within the broad ranges of those heretofore found suitable for FCC regenerators, especially those operating with substantially complete combustion of CO to CO2 within the regeneration zone. Suitable and preferred operating conditions are:

| | Broad | Preferred |
|---|---|---|
| Temperature, °F. | 1100–1700 | 1150–1400 |
| Catalyst Residence Time, Seconds | 60–3600 | 120–600 |
| Pressure, atmospheres | 1–10 | 2–5 |
| % Stoichiometric O2 | 100–120 | 100–105 |

CO COMBUSTION PROMOTER

Use of a CO combustion promoter in the regenerator or combustion zone is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. In swirl type regenerators, operation with 1 to 7 ppm Pt commonly occurs. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the FCC regenerator. More CO combustion promoter can be added without undue bad effect—the primary one being the waste of adding more CO combustion promoter than is needed to burn all the CO.

The present invention can operate with extremely small levels of CO combustion promoter while still achieving relatively complete CO combustion because the heavy, resid feed will usually deposit large amounts of coke on the catalyst, and give extremely high regenerator temperatures. The high efficiency regenerator design is especially good at achieving complete CO combustion in the dilute phase transport riser, even without any CO combustion promoter present, provided sufficient hot, regenerated catalyst is recycled from the second dense bed to the coke combustor. Catalyst recycle to the coke combustor promotes the high temperatures needed for rapid coke combustion in the coke combustor and for dilute phase CO combustion in the dilute phase transport riser.

Usually it will be preferred to operate with much higher levels of CO combustion promoter when either partial CO combustion is sought, or when more than 5-10% of the coke combustion is shifted to the second dense bed. More CO combustion promoter is needed because catalysis, rather than high temperature, is being relied on for smooth operation.

This concept advances the development of a heavy oil (residual oil) catalytic cracker and high temperature cracking unit for conventional gas oils. The process combines the control of catalyst deactivation with controlled catalyst carbon-contamination level and control of temperature levels in the stripper and regenerator.

The hot stripper temperature controls the amount of carbon removed from the catalyst in the hot stripper. Accordingly, the hot stripper controls the amount of carbon (and hydrogen, sulfur) remaining on the catalyst to the regenerator. This residual carbon level controls the temperature rise between the reactor stripper and the regnerator. The hot stripper also controls the hydrogen content of the spent catalyst sent to the regenerator as a function of residual carbon. Thus, the hot stripper controls the temperature and amount of hydrothermal deactivation of catalyst in the regenerator. This concept may be practiced in a multi-stage, multi-temperature stripper or a single stage stripper.

Employing a hot stripper, to remove carbon on the catalyst, rather than a regeneration stage, reduces air pollution, and allows all of the carbon made in the reaction to be burned to CO2, if desired.

The stripped catalyst is cooled (as a function of its carbon level) to a desired regenerator inlet temperature to control the degree of regeneration desired, in combination with the other variables of CO/CO2 ratio desired, the amount of carbon burn-off desired, the catalyst recirculation rate from the regenerator to the hot stripper, and the degree of desulfurization/denitrification/decarbonization desired in the hot stripper. Increasing CO/CO2 ratio decreases the heat generated in the regenerator, and accordingly decreases the regenerator temperature. Burning the coke, adhering to the catalyst in the regenerator, to CO removes the coke, as would burning coke to CO2, but burning to CO produces less heat than burning to CO2. The amount of carbon (coke) burn-off affects regenerator temperature, because greater carbon burn-off generates greater heat. The catalyst recirculation rate from the regenerator to the hot stripper affects regenerator temperature, because increasing the amount of hot catalyst from the regenerator to the hot stripper increases hot stripper temperature. Accordingly, the increased hot stripper temperature removes increased amounts of coke so less coke need burn in the regenerator; thus, regenerator temperature can decrease.

The catalyst cooler controls regenerator temperature, thereby allowing the hot stripper to be run at temperatures above the riser top temperature, while allowing the regenerator to be run independently of the stripper.

Use of an additional catalyst cooler, on catalyst exiting the stripper, also allows even greater circulation of catalyst to the regenerator riser to increase catalyst density in the regenerator riser, while controlling the regenerator temperature. This reduces catalyst deactivation and provides additional control.

The present invention strips catalyst at a temperature higher than the riser exit temperature to separate hydrogen, as molecular hydrogen or hydrocarbons from the coke which adheres to catalyst. This minimizes catalyst steaming, or hydrothermal degradation, which typically occurs when hydrogen reacts with oxygen in the FCC regenerator to form water. The high temperature stripper (hot stripper) also removes much of the sulfur from coked catalyst as hydrogen sulfide and mercaptans, which are easy to scrub. In contrast, burning from coked catalyst in a regenerator produces SOx in the regenerator flue gas. The high temperature stripping recovers additional valuable hydrocarbon products to prevent burning these hydrocarbons in the regenerator. An additional advantage of the high temperature stripper is that it quickly separates hydrocarbons from catalyst. If catalyst contacts hydrocarbons for too long a time at a temperature near or above 538 C. (1000 F.), then diolefins are produced which are undesirable for downstream processing, such as alkylation. However, the present invention allows a precisely controlled, short contact time at 538 C. (1000 F.) or greater to produce premium, unleaded gasoline with high selectivity.

The heat-exchanger (catalyst cooler) controls regenerator temperature. This allows the hot stripper to run at a desired temperature to control sulfur and hydrogen without interfering with a desired regenerator temperature. It is desired to run the regenerator at least 55 C. (100 F.) hotter than the hot stripper. Usually the regenerator should be kept below 871 C. (1600 F.) to prevent thermal deactivation of the catalyst, although somewhat higher temperatures can be tolerated when a staged catalyst regeneration is used, with removal of flue gas intermediate the stages.

I claim:

1. An apparatus for the fluidized catalytic cracking of a heavy hydrocarbon feed comprising hydrocarbons having a boiling point above about 650° F. to lighter products by contact said feed with catalytic cracking catalyst comprising:

a. a catalytic cracking reactor means having an inlet connective with a source of a heavy hydrocarbon feed and with a source of hot regenerated catalyst and having an outlet for discharging a cracking zone effluent mixture comprising cracked products and spent cracking catalyst containing coke and strippable hydrocarbons;

b. a separation means connective with said reactor outlet for separating said cracking zone effluent mixture into a cracked product rich vapor phase and a solids rich phase comprising said spent catalyst and strippable hydrocarbons;

c. a primary stripping means comprising an inlet for a source of hot regenerated cracking catalyst, an inlet for spent catalyst, an inlet for a stripping gas, a vapor outlet for a primary stripping stage vapor and a solids outlet for discharge of stripped solids;

d. a secondary stripping means comprising a vessel for containing a fluidized bed of catalyst and having an inlet for stripped solids connective with the solids outlet of said primary stripping means, an indirect heat exchange means immersed at an elevation within the fluidized bed of catalyst in the secondary stripping vessel for removal of heat, an inlet for a secondary stage stripping gas below said heat exchange means, and an outlet for stripped catalyst;

e. a catalyst regeneration means having an inlet connective with said catalyst outlet from said secondary stripping means, a regeneration gas inlet, a flue gas outlet, and an outlet for removal of hot regenerated catalyst;

f. a reactor catalyst recycle means having an inlet connective with said catalyst regeneration means and an outlet connective with said regenerated catalyst inlet of said catalytic cracking reaction zone; and g. a primary stripping zone catalyst recycle means having an inlet connective with said catalyst regeneration means and an outlet connective with said primary stripping zone.

2. The apparatus of claim 1 comprising means to remove the stripping gas effluent from the second stage of stripping separately from the cracked vapor products.

3. The apparatus of claim 1 wherein the secondary stripping means vessel contains both the primary stripping means and the secondary stripping means, and wherein the primary stripping means is above the fluidized bed of catalyst in the secondary stripping means and the solids outlet of said primary stripping means discharges stripped solids from the first stripping means down by gravity flow into the inlet for stripped solids of the secondary stripping means.

4. The apparatus of claim 1 wherein the catalytic cracking reactor means comprises a riser reactor.

5. The apparatus of claim 1 wherein the regenerator comprises:

a riser mixing means having an inlet at the base thereof for said cooled catalyst mixture and for an oxygen containing gas and an outlet at the top;

a coke combustion means for maintaining a fast fluidized bed of catalyst therein, having a catalyst inlet in a lower portion thereof connective with the outlet of the riser mixing means, an inlet within the fast fluidized bed for additional oxygen or oxygen containing gas, and an outlet in an upper portion thereof, and wherein at least a portion of the coke on said spent catalyst is burned to form a flue gas comprising CO and CO2;

a dilute phase transport riser having an inlet in a lower portion thereof connective with said coke combustion means outlet, and an outlet in an upper portion thereof, and wherein at least a portion of said CO in said flue gas is afterburned to CO2 in said riser to produce at least partially regenerated catalyst which is discharged from the outlet of the dilute phase transport riser;

a dense bed containment vessel for maintaining a dense phase fluidized bed of catalyst in a lower portion thereof, having an inlet means for receiving said at least partially regenerated catalyst from said dilute phase transport riser, and separation means connective with said dilute phase transport riser outlet for accepting and separating material discharged from the transport riser into a flue gas rich phase and a catalyst rich phase which is collected as a dense phase fluidized bed in a lower portion of said containment vessel, said vessel having regenerated catalyst outlet means at a lower portion thereof; and catalyst recycle means extending from said regenerated catalyst outlet means connective with said catalytic cracking reaction means and with said primary stage stripping means.

* * * * *